United States Patent [19]

Winstanley et al.

[11] Patent Number: 4,663,763

[45] Date of Patent: May 5, 1987

[54] CHARGE-LOAD SUPPORT FOR A GLOW DISCHARGE FURNACE

[75] Inventors: Ray Winstanley, S. Wirral, England; Trevor Farrell, Chester; Malcolm Booth, Chelmondiston, Nr. Ipswich, both of United Kingdom

[73] Assignee: The Electricity Council, London, England

[21] Appl. No.: 768,081

[22] Filed: Aug. 21, 1985

[30] Foreign Application Priority Data

Aug. 29, 1984 [GB] United Kingdom ..... 8421789

[51] Int. Cl.[4] ..... H05B 7/16

[52] U.S. Cl. ..... 373/26; 373/109

[58] Field of Search ..... 373/26, 109, 111, 110; 174/151, 15 BH

[56] References Cited

U.S. PATENT DOCUMENTS 2,266,735 12/1941 Berghaus et al. ..... 373/26

*Primary Examiner*—Roy N. Envall, Jr.

*Attorney, Agent, or Firm*—Beveridge, DeGrandi and Weilacher

[57] ABSTRACT

A charge-load support for use in a glow discharge furnace comprises first and second coaxial tubular members joined at one end and capped at the other end to provide a re-entrant entry to the space between the members, the outer member serving to protect the inner member against conductive deposit build-up thereon and the members together defining a relatively long convoluted path from the capping member to the other end thereby serving to reduce the risk of tracking in use of the support.

10 Claims, 1 Drawing Figure

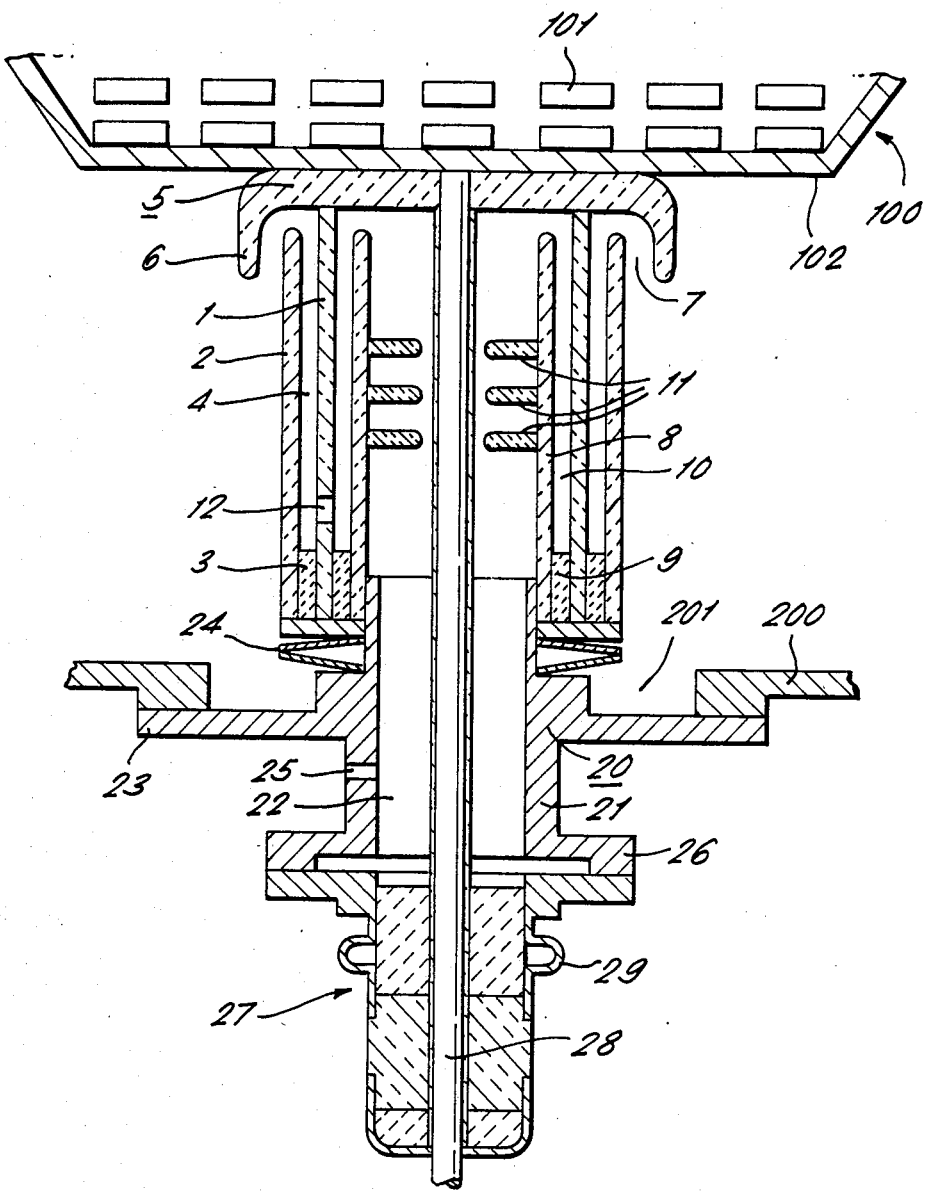
101
100
102
5
6
7
1
2
4
11
8
10
12
3
9
24
201
200
23
25
22
20
21
26
29
27
28

CHARGE-LOAD SUPPORT FOR A GLOW DISCHARGE FURNACE

BACKGROUND OF THE INVENTION

This invention relates to a charge-load support for a glow discharge furnace.

In glow discharge-plasma thermochemical treatment apparatus, for example in apparatus for plasma carburising a charge-load or workpieces in a low pressure furnace, the furnace wall usually forms the anode of the electrical supply while the charge-load forms the cathode of the supply.

The charge load must therefore be supported within the furnace, electrically isolated from the furnace wall, and have an electrical connection thereto which passes through the furnace wall.

A difficulty which arises in such a furnace is that during plasma carburising, electrically conductive deposits such as soot or sputter products can build-up within the furnace and provide short-circuit tracking paths for the electrical supply, thereby disturbing the glow discharge or at worst rendering the furnace inoperative.

Any build up of such conductive deposits can affect both the leadthrough electrical supply connection to the charge-load support, and the charge-load support itself.

In U.S. Pat. application Ser. No. 702,159, now abandoned, there is described and claimed a leadthrough arrangement which overcomes the difficulties of conductive deposit build-up.

SUMMARY OF THE INVENTION

According to this invention there is provided a charge-load support for a glow discharge furnace, comprising first and second tubular members of electrically insulating or semiconducting material, the first member being arranged within the second member and being connected thereto at one end of the first and second members such as to provide a space between the first and second members throughout the unconnected length of the second member, the first member extending beyond the second member at the other end of the first and second members, and a cap member closing said other end of the first member and having a rim extending about said other end of the second member and spaced therefrom to provide a re-entrant entry to said space.

In use of the support of this invention the cap member serves as a platform for supporting a charge-load, the weight of the load being supported by the first member of the support, which in use would be mounted on a wall of a furnace.

The second member of the support serve to protect the outer surface of the first member from the build-up of conductive deposits thereon during use of the support, while the cap member serves to inhibit the entry of conductive deposits into the space between the first and second members, the re-entrant entry to this space assisting in this. The members of the support also serve in use to define a relatively long convoluted path from a charge-load supported by the cap member to a furnace wall on which the first and second members are mounted, this serving to reduce the risk of tracking between the charge-load and the furnace wall.

BRIEF DESCRIPTION OF THE DRAWING

A charge-load support and an assembly including the support, according to this invention, will now be described by way of example with reference to the diagrammatic drawing which is a longitudinal sectional view through the support and assembly.

DETAILED DESCRIPTION OF A PREFERRED EMBODIMENT

The support and assembly to be described serves to support a charge-load 100 comprising a plurality of workpieces 101 in a conductive container 102, for plasma carburising in a low pressure glow discharge furnace having a wall 200 with a hole 201 therein in which the support assembly is mounted.

The support comprises first and second tubular members 1 and 2 made of a refractory material, the first member 1 being arranged withing the second member 2 and being connected thereto at one end (lower end in the drawing) by a refractory cement material 3 such as to provide an annular space 4 between the first and second members 1 and 2 throughout the unconnected length of the second member 2. The first member 1 extends beyond the second member 2 at the other end (upper end in the drawing) of the first and second members 1 and 2, and has mounted thereon a circular cap member 5 of refractory material, which closes the other end of the first member 1 and which has a depending rim 6 which extends about the other end of the second member, spaced therefrom, to provide a re-entrant entry 7 to the space 4 between the first and second members 1 and 2.

Arranged within the first member 1 is a third tubular member 8 made of refractory material, the third member 8 being connected to the first member 1 at the one end thereof by refractory cement material 9 such as to provide an annular space 10 between the first and third members 1 and 8 throughout the unconnected length of the third member 8, the other unconnected end of the third member 8 being spaced from the cap member 5.

Mounted on the inside of the third member 8 are three annular thermal shield members 11.

The first member 1 is formed with a port 12 providing communication between the spaces 4 and 10.

The support above described is part of an assembly which also includes a metal mounting member 20 having a tubular portion 21 and having a passage 22 extending therethrough. The mounting member 20 has a flange 23 intermediate its ends by which flange 23 the mounting member 20 is secured to the furnace wall 200, as by welding or by means of bolts, in air-tight manner, with the tubular portion 21 extending through the hole 201 in the furnace wall 200.

The support is mounted on the end of the tubular portion 21 within the furnace by means of a compliant member 24 capable of absorbing mechanical shocks acting axially of the support, with the passage 22 in the tubular portion 21 axially aligned with and in communication with the inside of the support.

The tubular portion 21 of the mounting member 20 is formed with a port 25 providing communication through the wall of the tubular portion 21 at a position outside the furnace.

The free end of the mounting member 20 outside the furnace is formed with a flange 26 to which is connected in air-tight manner as by welding or by means of bolts, a leadthrough arrangement 27 by which a charge-load 100 supported on the end cap 5 of the support is connected to one terminal of an electrical supply, The leadthrough arrangement is substantially as described in U.S. Pat. application Ser. No. 702,159, now abandoned, mentioned above, and will not therefore be described in detail herein. The basic essential feature is that the leadthrough arrangement 27 provides an electrical conductor in the form of a refractory sheathed conducting rod 28 which passes through the passage 22 in the mounting member 20, and with clearance through the holes in the thermal shield members 11 carried by the third member 8 of the support, and finally through the cap member 5 of the support for connection to the container 102 holding the workpieces 101 of the charge-load 100.

The leadthrough arrangement 27 incorporates a compliant, bellows-like member 29 which serves to allow for expansion and contraction in the arrangement during use.

For use of the assembly described above, the inside of the support and the passage 22 in the mounting member 20 are evacuated through the port 12 when the furnace is evacuated, the port 25 being closed in airtight manner. The furnace wall 200 is connected to the anode of an electrical supply and the conductor 28 of the leadthrough arrangement 27 is connected to the cathode of the supply, and a glow discharge established between the furnace wall 200 and the workpieces 101 supported in the container 102 on the cap member 5 of the support and electrically connected to the conductor 28.

During use the temperature at the cap member 5 can be of the order of 1000° C., and the thermal shield members 11 in the support serve to reduce the heat flow within the support.

As mentioned above, during use conductive deposits are formed within the furnace, but the form of the support, and the form of the leadthrough arrangement, serves to prevent such desposits having an adverse effect on the operation of the furnace. Further, a reactive or purge gas can be introduced into the assembly through the port 25, such gas passing through the passage 22 in the mounting member 20, and through the spaces 10 and 4 between the first and third members 1 and 8, and first and second members 1 and 2 of the support, passing by way of the port 12, thereby to impede the ingress of deposits into the support, and if reactive reacting with any such deposits to achieve their removal as a gas. For example, if oxygen is used this will react at the furnace temperature with carbon soot deposits to form carbon dioxide.

Although the assembly described above includes an electrical leadthrough arrangement 27 this is not essential if the necessary electrical supply to the furnace is otherwise provided, in which case the mounting member 20 can simply be sealed by a plate secured to the flange 26 thereof. Otherwise the mounting member 20 can simply be used for the passage of leads of, for example, a thermocouple or a transducer located on the support, into the furnace, by the use of a suitable plate secured to the flange 26 of the mounting member 20.

We claim:

1. A charge load support for use as a cathodic support in a glow discharge furnace, comprising first and second tubular members of electrically insulating or semiconducting material, the first member being arranged within the second member and being connected thereto at one end of the first and second members such as to provide a space between the first and second members throughout the unconnected length of the second member, the first member extending beyond the second member at the other end of the first and second members, and a cap member closing said other end of the first member and having a rim extending about said other end of the second member and spaced therefrom to provide a re-entrant entry to said space.

2. A support as claimed in claim 1, including a third tubular member of electrically insulating or semiconducting material arranged within the first member and connected thereto at saidone end of the first member such as to provide a space between the first and third members throughout the unconnected length of the third member, the other unconnected end of the third member being spaced from the cap member.

3. A support as claimed in claim 2, in which the third member carries one or more thermal shield members extending into but not closing the third member.

4. A support as claimed in claim 2 or claim 3, in which the first and third members are connected together by a refractory cement material.

5. A support as claimed in claim 1, in which the first and second members are connected together by a refractory cement material.

6. A support as claimed in claim 1, in which the first member is formed with a port providing communication between the space between the first and second members and the inside of the first member.

7. A charge-load support assembly for use as a cathodic support in a glow discharge furnace, comprising a support including first and second tubular members of electrically insulating or semiconducting material and a cap member, the first member being arranged within the second member and being connected thereto at one end of the first and second members such as to provide a space between the first and second members throughout the unconnected length of the second member, the first member extending beyond the second member at the other end of the first and second members, with the cap member closing said other end of the first member and having a rim extending about said other end of the second member and spaced therefrom to provide a re-entrant entry to said space; and a mounting member adapted to be secured to a wall of a furnace over a hole therein with a tubular portion of the mounting member providing a passage extending through said hole, the support being mounted on the end of said tubular portion, which in use is within the furnace, with the passage provided by said tubular portion in communication with the inside of the first member of the support.

8. An assembly as claimed in claim 7, in which the support is mounted on the mounting member by means of a compliant member adapted to absorb mechanical shocks acting axially of the support.

9. An assembly as claimed in claim 7 or claim 8, including a leadthrough arrangement mounted on the end of said tubular portion, which in use is outside the furnace, the leadthrough arrangement providing on insulated electrical conductor extending from the free end of the arrangement through the passage in the tubular portion of the mounting member, and through the cap member of the support for connection in use to a charge-load supported by the cap member of the support.

10. An assembly as claimed in claim 7, in which the tubular portion of the mounting member is formed with a port providing communication through the waII of the tubular portion at a position which in use is outside the furnace.

* * * * *